US012196122B2

(12) United States Patent
Nguyen et al.

(10) Patent No.: US 12,196,122 B2
(45) Date of Patent: Jan. 14, 2025

(54) ENGINE COOLANT THERMOSTAT HOUSING

(71) Applicant: RB Distribution, Inc., Colmar, PA (US)

(72) Inventors: Tam Van Nguyen, Philadelphia, PA (US); Brian Murphy, Fairless Hills, PA (US); William Crossley, Warminster, PA (US); Bryan McMasters, Telford, PA (US); Sean Cattie, Perkasie, PA (US); Jessica Miron, Philadelphia, PA (US)

(73) Assignee: RB Distribution, Inc., Colmar, PA (US)

( * ) Notice: Subject to any disclaimer, the term of this patent is extended or adjusted under 35 U.S.C. 154(b) by 0 days.

(21) Appl. No.: 17/826,391

(22) Filed: May 27, 2022

(65) Prior Publication Data

US 2023/0383689 A1 Nov. 30, 2023

(51) Int. Cl.
*F01P 7/16* (2006.01)

(52) U.S. Cl.
CPC ..... *F01P 7/16* (2013.01); *F01P 2025/08* (2013.01)

(58) Field of Classification Search
CPC ..... F28F 1/18; F28F 1/20; F28F 1/28; F28F 1/30; F01P 1/00; F01P 1/06
See application file for complete search history.

(56) References Cited

U.S. PATENT DOCUMENTS

| | | | | | |
|---|---|---|---|---|---|
| 2,717,916 | A * | 9/1955 | Harkness | F02P 3/12 | 361/260 |
| 3,034,449 | A * | 5/1962 | Moore | F01C 1/063 | 418/36 |
| 3,194,372 | A * | 7/1965 | Weir | F16D 35/00 | 192/58.68 |
| 3,769,944 | A * | 11/1973 | Raymond | F02B 53/00 | 123/235 |
| 3,877,443 | A | 4/1975 | Henning et al. | | |
| 4,266,645 | A * | 5/1981 | Crooks | F16D 35/00 | 192/82 T |
| 4,359,980 | A * | 11/1982 | Somraty | F01C 1/073 | 418/35 |
| 4,483,278 | A * | 11/1984 | Kolacz | F02B 75/34 | 434/389 |
| D290,364 | S | 6/1987 | Wilkinson | | |
| 5,090,375 | A * | 2/1992 | Hudson | F02B 75/16 | 123/196 R |
| 7,353,793 | B1 | 4/2008 | Estacio | | |

(Continued)

FOREIGN PATENT DOCUMENTS

| | | |
|---|---|---|
| CN | 204984577 U | 1/2016 |
| FR | 2864151 B1 | 8/2007 |

(Continued)

OTHER PUBLICATIONS

Canadian Office Action dated Oct. 12, 2023 for Canadian patent application No. 3,168,615. English translation attached.

*Primary Examiner* — John Kwon
(74) *Attorney, Agent, or Firm* — Volpe Koenig

(57) ABSTRACT

A casted thermostatic housing for an engine coolant system. The housing has a plurality of exterior heat dissipating projections. An interior post for contacting a thermostatic element is circular and preferably tapered. The housing is casted metal and is preferably aluminum.

6 Claims, 5 Drawing Sheets

(56) References Cited

U.S. PATENT DOCUMENTS

2004/0141858 A1* 7/2004 Grant ..... F04B 35/002 417/372
2008/0120974 A1* 5/2008 Dong ..... B60K 17/043 60/464
2008/0293312 A1* 11/2008 Scott ..... B63H 20/007 440/67
2008/0310972 A1* 12/2008 Dong ..... F16H 61/4165 137/601.19
2009/0038580 A1* 2/2009 Hamilton ..... F28F 3/048 29/890.035
2011/0303198 A1* 12/2011 Thomson ..... F02B 39/14 74/417
2013/0152880 A1 6/2013 Bellinger et al.
2014/0166378 A1* 6/2014 Mair ..... H02K 7/116 180/65.6
2014/0259512 A1* 9/2014 Betton ..... A47L 11/4083 15/320
2015/0070841 A1* 3/2015 Suzuki ..... H02M 7/537 361/689
2016/0047300 A1* 2/2016 Mueller ..... F02B 75/02 123/42
2016/0348636 A1* 12/2016 Ghosh ..... F02P 23/04
2017/0279337 A1* 9/2017 Komura ..... H02K 5/18
2019/0355502 A1* 11/2019 Cayton ..... F16D 35/024
2020/0158001 A1 5/2020 Lee
2020/0158002 A1 5/2020 Lee
2020/0182128 A1 6/2020 Lee
2020/0191043 A1 6/2020 Lee
2020/0217429 A1* 7/2020 Nguyen ..... F16K 15/1823
2020/0263597 A1 8/2020 Lee
2021/0189925 A1* 6/2021 Ströse ..... F01M 13/022
2022/0307496 A1 9/2022 Wu et al.
2022/0307499 A1 9/2022 Wu et al.

FOREIGN PATENT DOCUMENTS

GB 2261934 B 9/1995
JP 2010144613 A 7/2010
WO 2019013730 A2 1/2019
WO 2022137687 A1 6/2022

* cited by examiner

ENGINE COOLANT THERMOSTAT HOUSING

FIELD OF INVENTION

The present disclosure is generally related to the technical field of liquid cooled engines. More particularly, the present embodiments are related to the field of thermostatic temperature controls for engine cooling systems.

BACKGROUND

Thermostatic devices disposed in cooling systems of internal combustion engines and the like typically comprise a sensor case having a built-in thermal expansion body which perceives temperature changes in cooling liquids which fills the circulation channels of a cooling system and expands and contracts accordingly. The valve body opens and closes in response to volumetric change accompanying the expansion and contraction of the thermal expansion body, and thus the thermostat device functions to maintain cooling liquid at a predetermined temperature.

The housing that holds the thermostat device directs the coolant flow to the heater, and to the radiator when the thermostat that is located inside the thermostat housing is opened when the coolant fluid has reached a temperature limit.

The high temperatures and the temperature cycling cause the housing to become brittle leading to cracking of the housing, because the housing is made of the plastic material. The cooling system needs to continuously regulate the coolant temperature in order to maintain a proper operating temperature for the engine. If the housing is cracking it can lead to the coolant fluid leaking out which causes the engine to overheat. Also, partial degradation of any of the parts leads to improper coolant flow.

While conventional cooling system and components have generally been considered satisfactory for their intended purpose there is still a need in the art for improved coolant systems that handle high temperatures and temperature cycling. The present disclosure provides a solution for this need.

FIG. 1 is a perspective view of a known plastic molded thermostat housing assembly that suffers from cracking due to heat and temperature cycling. The housing A has an elevated section B that define an internal cavity for coolant flow and is connected to the bleeder D. The base C is configured for attachment to an existing engine. The internal post E has a circular base F that contact a thermostatic element and a "T" shaped extension having the perpendicular section G and H to connect to section B.

SUMMARY

A housing for a thermostatic element in a coolant system of an internal-combustion engine. The housing has a plurality of cooling fins or heat sinks for dissipating heat from the housing.

The fins are of various sizes and are distributed about the external surfaces of the housing.

The interior of the housing has a dependent post for contact with a thermostatic element. The dependent post is generally circular and is tapered to reduce turbulence in the coolant flow through the housing.

These and other features of the disclosed invention will become readily apparent to those skilled in the art from the following detailed description taken in conjunction with the drawings.

BRIEF DESCRIPTION OF THE DRAWINGS

The following detailed description will be better understood when read in conjunction with the drawings. In the drawings.

DETAILED DESCRIPTION

Figure 1:
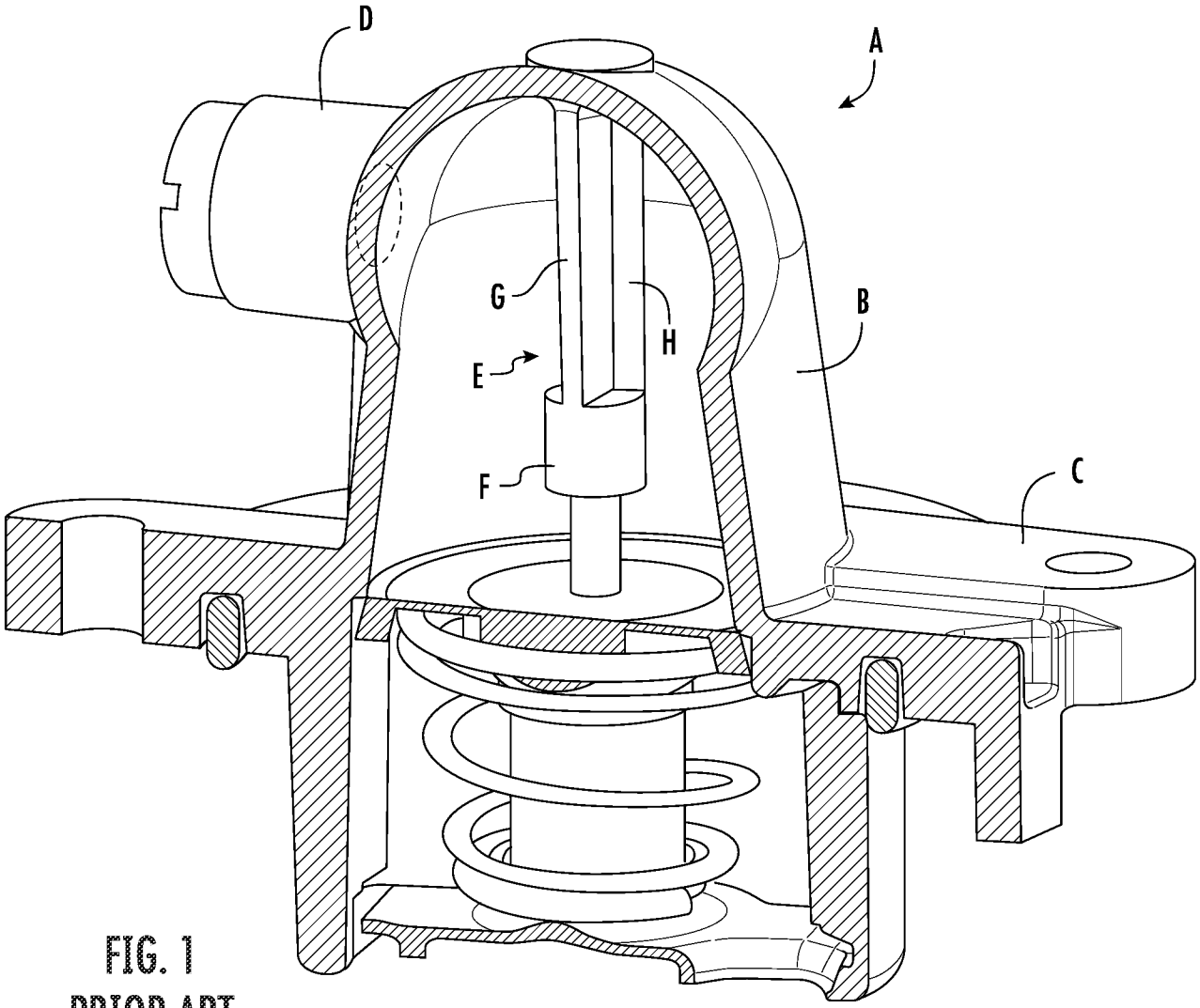
FIG. 1 PRIOR ART
FIG. 1 is an illustration of a known thermostat housing assembly.

A detailed description of the inventions will be made to the drawings wherein like reference numerals identify similar structural features or aspects of the subject disclosure.

Figure 2:
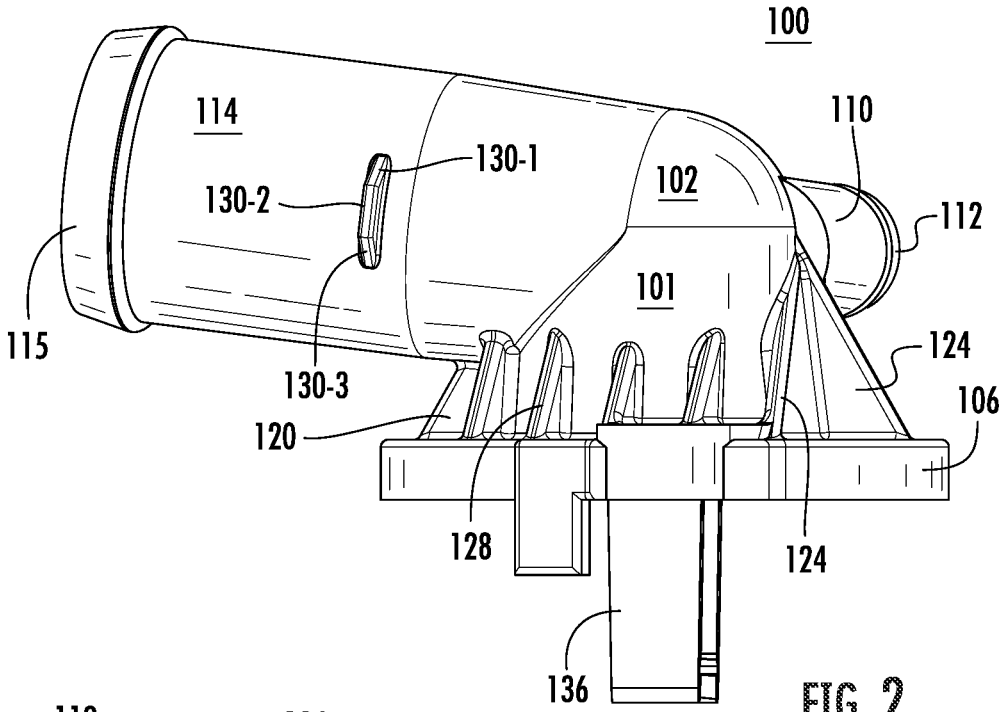
FIG. 2 is a perspective view of a coolant thermostat housing according to the present invention.

A side view of the present housing 100 is shown in FIG. 2. The housing 100 has an outlet 114 that terminates in a lip or flared end 115 that is dimensioned for a hose to connect with a radiator or other cooling feature. This configuration will be known to those skilled in the art. The housing 100 has a base or outer flange 106 configured for assembly with an existing engine. The base 106 has an open interior 107 and opposed dependent grippers 136 configured for holding a thermostatic element 138 beneath the open interior 107. A plurality of cooling fins or heat sinks 120,124, and 128 are spaced about the lower section of housing 100 or generally circular wall 101. Circular wall 101 supports an upper domed portion 102 which is connected to the generally horizontal fluid outlet 114. The circular wall 101, domed portion 102, conduit 114 and a bleeder 110 are all in fluid communication.

Figure 3:
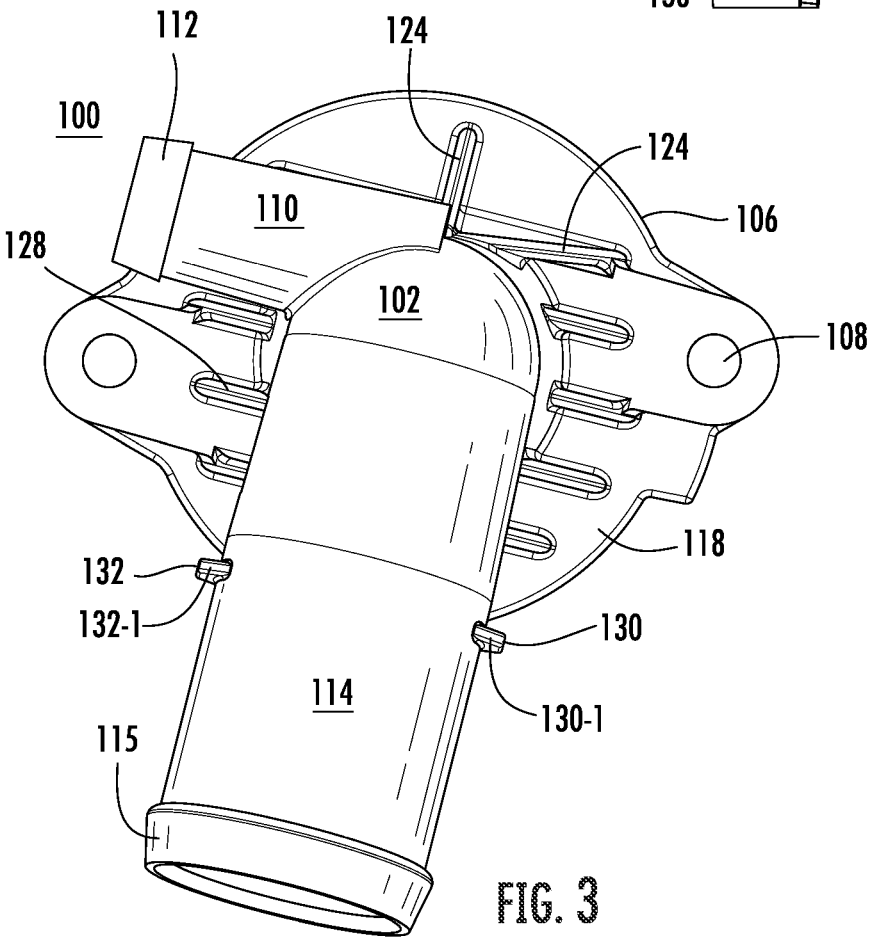
FIG. 3 is a top view of the coolant thermostat housing in FIG. 2.
Figure 4:
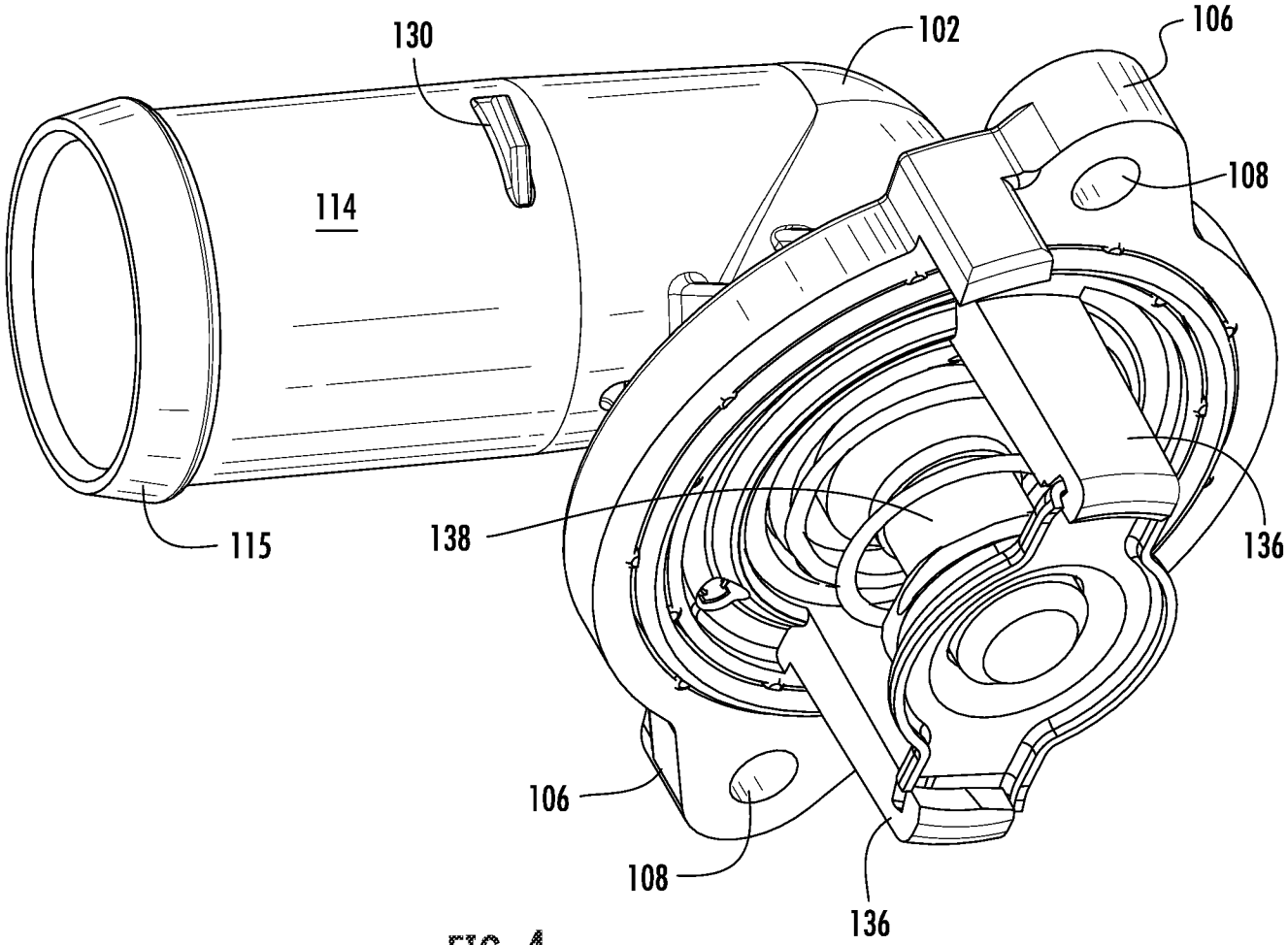
FIG. 4 is a bottom perspective of an assembly of a thermostatic element with the coolant thermostat housing shown in FIG. 2.
Figure 5:
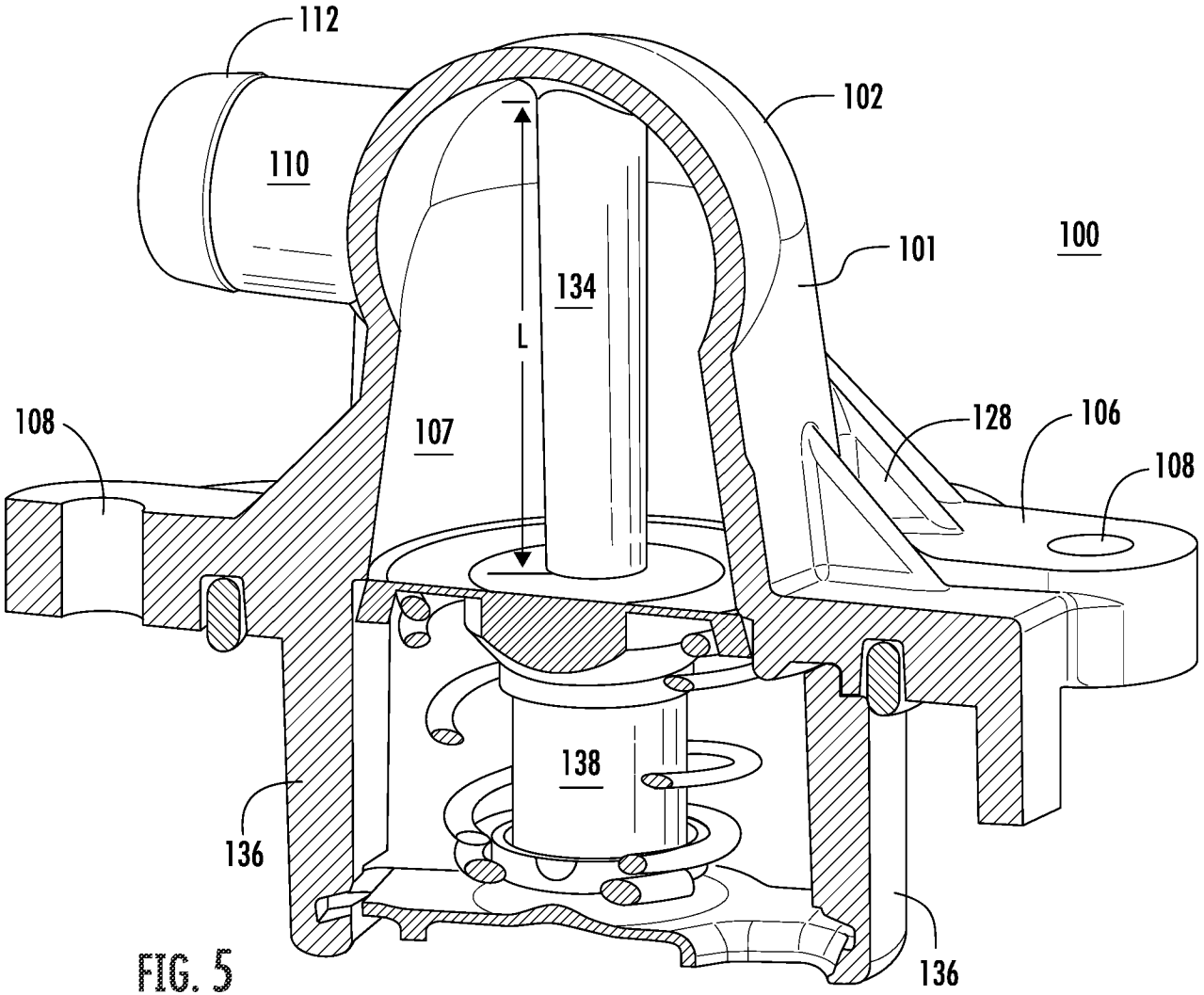
FIG. 5 is a cross-sectional view of the coolant thermostat housing of FIG. 2 assembled with a thermostatic element.
Figure 6:
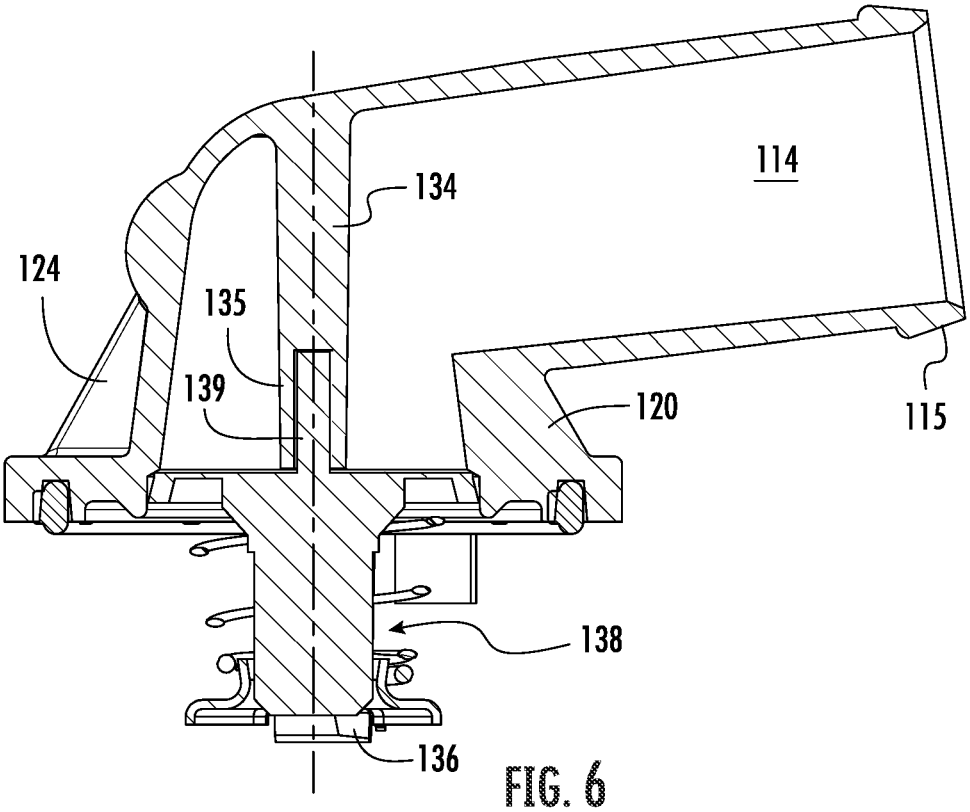
FIG. 6 is a cross-section view illustrating the assembled connection between a thermostatic element and the thermostat housing assembly of FIG. 2.
Figure 7:
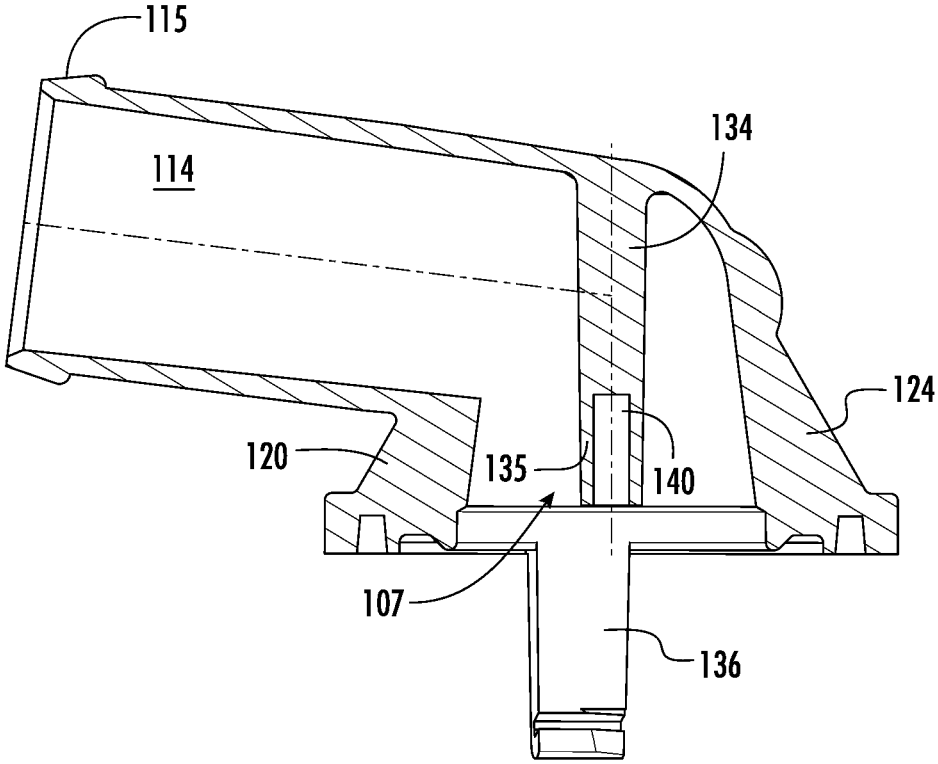
FIG. 7 is a cross-sectional view illustrating the taper in the dependent post the housing of FIG. 2, without a thermostatic element.

With reference to FIGS. 3 to 5, the bleeder 110 has a threaded end 112 that receives an internal closer 112. The bleeder 110 is supported by the domed portion 102 and is used for purging the internal fluid communications. With reference to FIG. 4, this figure illustrates an assembly of a thermostat and a housing 100 prior to connection with an existing engine. As shown in the section of FIGS. 4 to 7, the thermostatic element 138 is support by the dependent holders 136 so that the upstanding stem 139 from thermostatic element 138 is in contact with the downwardly dependent post 134 in the domed portion 102 of the housing 100. The end of the stem 139 is received within the recess 135 formed at the end of the post 134. The length 'L" of post 134 is selected according to the specific application so that there is contact between the bottom of post 134 and the top of thermostatic element 138, see FIGS. 5-7. As illustrated in FIGS. 6 and 7, the post 134 tapers downwardly from the upper dome portion 102 toward the recess 135. This taper in the post 134 provides a smooth transition throughout the length of the post 134 which eliminates turbulence caused by different surface geometries.

The plurality of projections around the circular wall 101 are generally rectangular in shape and extend outwardly from the base 106 up along the circular wall 101. The projections 124 have a greater height than the projections 118, 120 and 128. The projections 130 and 132 on outlet 114 generally have a three side configuration, i.e. 130-1, 130-2 and 130-3, see FIGS. 2 and 3.

The housing 100 is casted in metal as a single unit and the preferred metal is aluminum. Aluminum is a good heat conductor and is known to surrender heat to the surrounding atmosphere more quickly than other metals.

The above described and illustrated thermostatic housing is believed to provide superior heat management and thermal cycling.

What is claimed is:

1. A casted metallic thermostatic housing for an internal-combustion engine coolant system, the thermostatic housing comprising:

a unitary body having:

a first body portion that has an open interior surrounded by a flange, configured for mounting the first body portion to an existing engine, and dependent thermostatic element holders;

a second dome shaped body portion that overlies the first body portion and defines an interior cavity over the open interior of the first body portion, the second dome shaped body portion has a conically tapered dependent post of a predetermined length that tapers toward the first body portion along the predetermined length; and, a third body portion that is in fluid communication with the second dome shaped body portion and defines a coolant transport conduit wherein the dependent post has a free end and the free end has a recess that receives a stem associated with a thermostatic element.

2. The thermostatic housing of claim 1, wherein the housing has a plurality of heat dissipating projections.

3. The thermostatic housing of claim 2, wherein the plurality of heat dissipating projections are distributed about an external surface of the housing.

4. The thermostatic housing of claim 1, wherein the thermostatic housing is casted aluminum.

5. A unitary casted metallic housing for assembling a thermostat to an internal combustion engine, the unitary casted metallic housing comprising:

a first body portion configured for supporting a thermostatic element, a second dome shaped body portion configured for mounting the first body portion on an engine, and a third body portion that is in fluid communication with the second body portion and defines a conduit for transporting coolant to a radiator, wherein the second dome shaped body portion of the housing includes a plurality of external heat dissipating projections and an internal dependent post with a circular cross-section and a recess for receiving a portion of a thermostatic element.

6. A thermostatic housing for an internal-combustion engine coolant system, the thermostatic housing comprising:

a first body portion that has an open interior surrounded by a flange configured for mounting the first body portion to an existing engine;

a second dome shaped body portion that overlies the first body portion and supports an integral post that extends toward the first body portion and includes a free end having a recess for receiving a portion of a thermostatic element; and, a third body portion that is in fluid communication with the second dome shaped body portion and defines a coolant transport conduit wherein the dependent post has a free end and the free end has a recess that receives a stem associated with a thermostatic element.

* * * * *